US010260301B2

(12) United States Patent
Limb et al.

(10) Patent No.: US 10,260,301 B2
(45) Date of Patent: Apr. 16, 2019

(54) CUT TO RELEASE PACKER EXTENSION

(71) Applicant: BAKER HUGHES, LLC, Houston, TX (US)

(72) Inventors: Christopher J. Limb, Cypress, TX (US); Frank J. Maenza, Houston, TX (US); Gary L. Anderson, Humble, TX (US)

(73) Assignee: BAKER HUGHES, LLC, Houston, TX (US)

( * ) Notice: Subject to any disclaimer, the term of this patent is extended or adjusted under 35 U.S.C. 154(b) by 157 days.

(21) Appl. No.: 15/414,176

(22) Filed: Jan. 24, 2017

(65) Prior Publication Data

US 2018/0209238 A1 Jul. 26, 2018

(51) Int. Cl.
*E21B 23/00* (2006.01)
*E21B 29/00* (2006.01)

(52) U.S. Cl.
CPC ..... *E21B 29/00* (2013.01); *E21B 23/00* (2013.01)

(58) Field of Classification Search
CPC ..... E21B 33/12; E21B 17/042; E21B 17/06; E21B 29/00; E21B 29/02; E21B 23/00; E21B 31/00; E21B 31/16
See application file for complete search history.

(56) References Cited

U.S. PATENT DOCUMENTS 1,839,310 A * 1/1932 Hatcher ..... E21B 23/06 166/143
2,273,017 A * 2/1942 Boynton ..... E21B 17/0423 285/288.5
3,631,924 A * 1/1972 McGill ..... E21B 23/06 166/123
4,526,229 A * 7/1985 Dickerson ..... E21B 33/1295 166/120
4,554,976 A * 11/1985 Hynes ..... E21B 47/1025 166/337
5,479,991 A * 1/1996 Robison ..... E21B 33/12 166/133
2002/0121380 A1* 9/2002 Doane ..... E21B 23/01 166/382
2002/0144817 A1* 10/2002 Doane ..... E21B 23/00 166/298

(Continued)

FOREIGN PATENT DOCUMENTS

GB 2412932 A * 10/2005 ..... E21B 17/06
GB 2425552 A * 11/2006 ..... E21B 23/00

*Primary Examiner* — Jennifer H Gay
(74) *Attorney, Agent, or Firm* — Shawn Hunter

(57) ABSTRACT

A string from the surface is connected to a packer extension with a thread to provide a metal to metal seal for production or injection through the packer. The thread provides a metal to metal seal. The initial string is released from the packer extension by a tubular cut made with a cutting tool above the thread that provides the metal to metal seal to the packer extension. An outer sleeve surrounds an expanded length of wall which is the target cut zone above the threaded connection. A cut through the tubular does not cut the outer sleeve. The outer sleeve features a left handed square thread to engage a known released tool run in on a string to connect to the packer release mechanism and release the packer for removal with the release tool suspended from a string.

12 Claims, 3 Drawing Sheets

(56) References Cited

U.S. PATENT DOCUMENTS

| | | | | |
|---|---|---|---|---|
| 2009/0056947 | A1* | 3/2009 | Du | E21B 17/06 166/313 |
| 2010/0288491 | A1* | 11/2010 | Cochran | E21B 29/005 166/250.01 |
| 2011/0056676 | A1* | 3/2011 | Birner | E21B 33/1295 166/120 |
| 2013/0180735 | A1* | 7/2013 | Patel | E21B 33/13 166/387 |
| 2013/0277050 | A1* | 10/2013 | Cherian | E21B 43/17 166/271 |
| 2015/0267503 | A1* | 9/2015 | Foong | E21B 33/1293 166/378 |
| 2016/0305217 | A1* | 10/2016 | Patel | E21B 43/08 |
| 2018/0128059 | A1* | 5/2018 | Maenza | F16L 15/002 |
| 2018/0209238 | A1* | 7/2018 | Limb | E21B 33/12 |

* cited by examiner

CUT TO RELEASE PACKER EXTENSION

FIELD OF THE INVENTION

The field of the invention is mechanically releasable packers with a release tool and more particularly with a metal to metal string connection to a packer extension without a seal assembly in a seal bore and where cutting the string exposes a thread to engage the retrieval tool o release and remove the packer.

BACKGROUND OF THE INVENTION

FIG. 1 illustrates a known way to connect a string 10 to a packer P via a packer extension 12. Extension 12 has a polished seal bore 14 against which a seal stack 16 is positioned. When the seal stack 16 is in position a thread 18 is made up. This thread makeup also secures the position of a metal to metal seal 20 against the surrounding extension 12. A left hand square thread 18 is exposed when string 10 is rotated to undo thread 18 and a release tool of a known design is run in and engaged to thread 18. The release tool that is not shown also engages a sleeve on the packer to release the packer upon application of an uphole force. The seal stack 16 is intended to be a backup to the metal to metal seal 20. The issue with this design is that operators are disinclined to rely on a seal stack for a backup. The presence of a seal stack requires a different and more complex testing regimen. The other potential issue with this design is that the metal to metal seal 20 under severe thermal and/or tensile loads could lose its seal and the operators were leery of falling back on the seal stack for a secure connection that would not leak.

More recently an improved design was published as US 20180128059. For context in understanding the present invention, FIG. 2 is from that application that is commonly assigned to the same assignee, Baker Hughes Incorporated and has common inventorship. FIG. 2 shows a packer extension 30 engaged by a string 32 at thread 34. There is no seal bore just a metal to metal seal in the form of thread 34. Release of the packer P requires undoing thread 34 and removing the string 32 followed by running in a release tool to engage left handed square thread 36 with a known release tool that grabs a sleeve on the packer P in a known way to release it so that the packer and extension 30 come out together with the release tool engaged to thread 36. This novel design eliminated the need for a seal bore and addressed the operator concern of the metal to metal seal 20 losing its seal under extreme conditions as described above. However, operators raised a new concern with regard to the unique FIG. 2 design in that there could be situation where the torque required to release the threaded connection 34 could be higher than equipment capability from the surface to unthread or even worse the torque applied could be so high that the tubular string could shear at or outside the thread 34 which could cause an expensive fishing or milling operation to be undertaken.

The present invention overcomes the operator concern to the FIG. 2 design and provides a release from the packer with a mandrel sever above the metal to metal threaded connection. This cutting allows for string removal and exposes a left handed square thread that can then be engaged by a known packer release tool for release and removal of the packer with the release tool. No rotation is needed for the release of the original string from the packer. These and other aspects of the present invention will be more readily understood by a review of the description of the preferred embodiment and the associated drawings while recognizing that the full scope of the invention is to be determined by the appended claims.

SUMMARY OF THE INVENTION

A string from the surface is connected to a packer extension with a thread to provide a metal to metal seal for production or injection through the packer. The thread provides a metal to metal seal. The initial string is released from the packer extension by a tubular cut made with a cutting tool above the thread that provides the metal to metal seal to the packer extension. An outer sleeve surrounds an expanded length of wall which is the target cut zone above the threaded connection. A cut through the tubular does not cut the outer sleeve. The outer sleeve features a left handed square thread to engage a known released tool run in on a string to connect to the packer release mechanism and release the packer for removal with the release tool suspended from a string. No rotation is needed to release the packer or to expose the engagement thread for the release tool.

DETAILED DESCRIPTION OF THE PREFERRED EMBODIMENT

Figure 1:
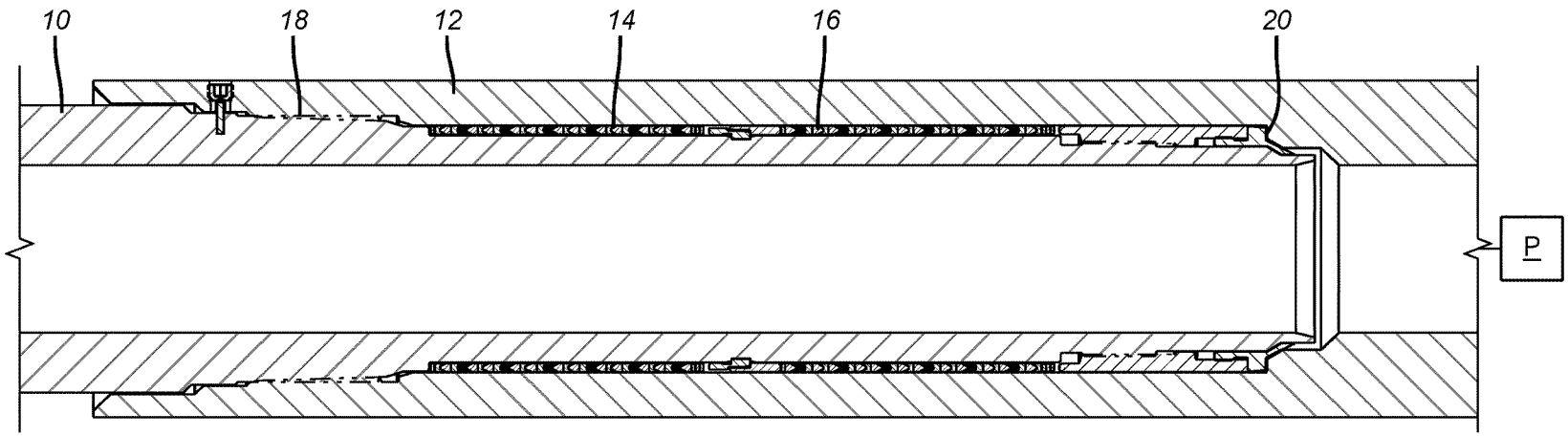
(PRIOR ART) FIG. 1
FIG. 1 is a section view of a prior art connection to a packer extension with a metal seal and a resilient seal stack in a seal bore.
Figure 2:
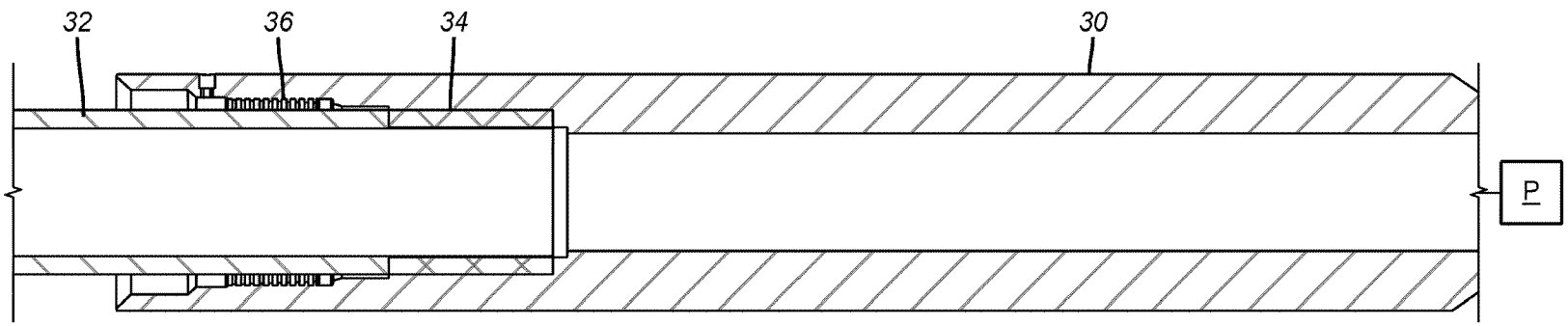
(PRIOR ART) FIG. 2
FIG. 2 is a recent improvement disclosed in an application filed in November 2016 where the seal bore is removed and a threaded connection is a metal to metal seal to the packer extension.
Figure 3:
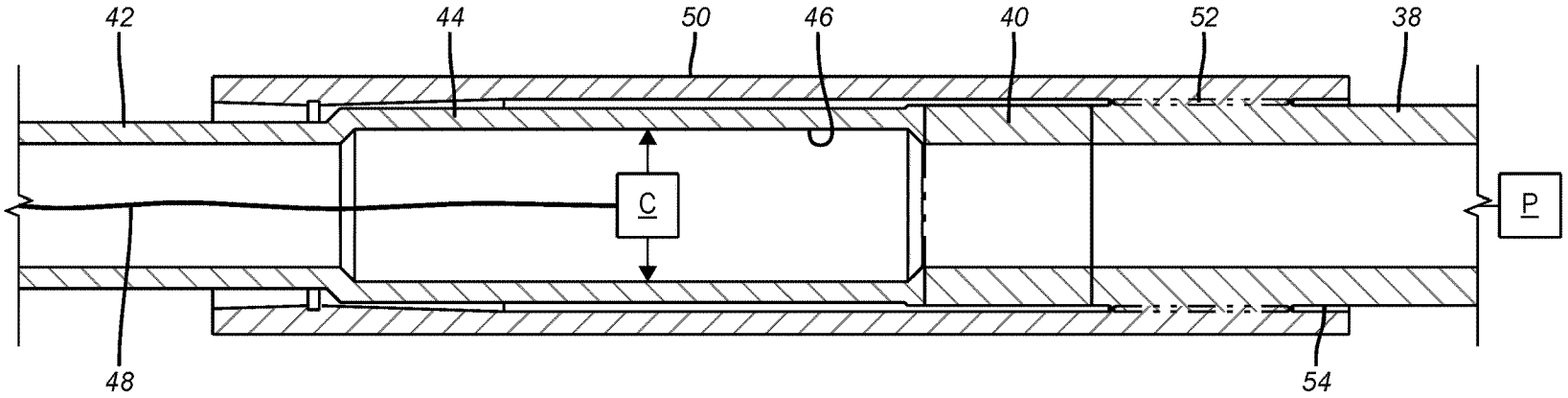
FIG. 3 is the present invention with the packer in service and connected to a string.
Figure 4:
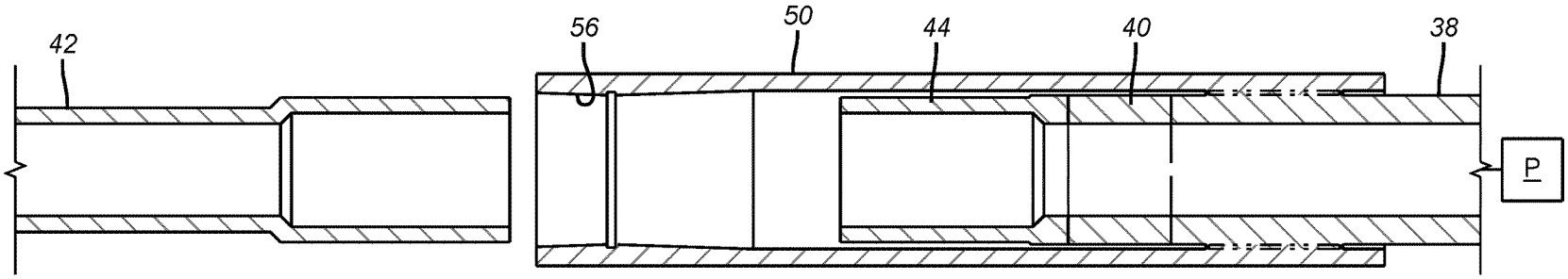
FIG. 4 is the view of FIG. 3 with the string cut above the threaded connection to expose the thread on an outer sleeve about the length of wall section (cut zone) for engagement by a known release tool.

FIG. 3 shows a packer P with a connected extension 38 that ends in a threaded connection 40 that allows the string 42 to support the packer P for running in and setting. String 42 above its lower thread at connection 40 has a length of tubing (cut zone) 44 that is defined by an internal recess 46. A cutting tool schematically represented as C is located in recess 46 by a delivery string, wireline or slickline 48, to name a few examples. The cutting tool C is of a known design and when it and when its use is finished the thin walled section is severed to release the string 42 from the packer extension 38 at a location uphole from the threaded connection 40 that holds them together. Since wall 44 is cut through the string 42 does not need to be rotated. The cutting tool C can be rotated and further features a limiting device on radial extent of the cutting so that outer sleeve 50 connected at thread 52 to the outer surface 54 of extension 38 will not be cut. The restraint on the radial extent of the cut through thin wall section 44 can be accomplished in non-mechanical ways depending on the manner that the thin wall section 44 is cut. The cut can be accomplished in various ways such as a jet cutter or laser for example. Cutting through thin walled section 44 allows removal of string 42 above threaded connection 40 as shown in FIG. 4 after removal of the cutting tool C. At this time the female thread 56 is exposed on outer sleeve 50. When the release tool that is not shown is secured at thread 56 another part of the tool engages a release sleeve that is not shown on the known packer P so that a pulling force on the release tool brings out the packer P with the release tool. While the use of a cutting tool C requires a trip into the hole to make the cut the string 42 is cut loose without a need to rotate that had caused some concern to operators with the FIG. 2 design. In essence the removal thread 56 which is preferably a left hand square thread is moved to a different structure to avoid damage to it when the tubular string 42 is cut above the threaded connection 40 to the packer extension 38. While the drift dimension is increased to accommodate sleeve 50 and the pressure rating of the string is somewhat reduced due to the thin section 44 those are the tradeoffs for releasing the string without rotation.

Item 42 is a prepared tubular that has the approximate tubing OD and ID dimensions at each end, and a section of expanded OD and ID (which may be as thick or thicker so as to maintain sufficient pressure and load rating similar to the base tubing dimensions) in between. The threaded connection 40 will be the same threaded connection size and type as the end connections at the top of 42, which connects to the operator's tubing string, and the bottom of item 38, which connects to the packer. The upset in ID and OD in the cut zone provides a clearance for an entry bevel for the retrieving tool or other equipment that may need to pass through the packer after cutting this zone and retrieving the tubing above.

A secondary option to retrieving the packer is to latch into the left hand thread with a non-sealing anchor to locate position for a second packer above the first, in which case the expanded ID at the cut zone would provide clearance to receive a non-sealing tubular within (possibly with a mule-shoe guide) to provide a continuous bore for running wire-line tools, if desired.

The above description is illustrative of the preferred embodiment and many modifications may be made by those skilled in the art without departing from the invention whose scope is to be determined from the literal and equivalent scope of the claims below:

We claim:

1. A packer assembly supported on a tubular string, comprising:

a packer comprising an extension featuring a connection thread for a connection segment of the tubular string in said extension, said extension surrounded by an outer sleeve spanning over said connection thread and further comprising a release thread adjacent an uphole end of said outer sleeve, said connection segment releasable from said extension without rotation to expose said release thread for release and removal of said packer;

a cutting tool to sever said connection segment at a location uphole from said release thread;

said connection segment has a cut zone defined by an internal recess for locating said cutting tool for a cut.

2. The assembly of claim 1, wherein:

said cut zone further comprises a protruding section compared to an adjacent portion of said connection segment.

3. The assembly of claim 1, wherein:

said release thread comprises a left hand square thread.

4. A retrievable packer removal method, comprising:

severing a tubular string threaded to a packer extension;

removing a severed portion of the tubular string from the packer extension;

exposing a release thread on a sleeve connected to said packer extension by removing said severed portion of the tubular string from said packer extension;

releasing a grip assembly of said packer with a force applied from said release thread.

5. The method of claim 4, comprising:

providing a wall segment in said string as the location for said severing.

6. The method of claim 5, comprising:

providing a gap between said thin wall segment and said sleeve to prevent cutting into said sleeve.

7. The method of claim 5, comprising:

configuring an internal recess with said wall segment for locating a cutting tool.

8. The method of claim 5, comprising:

locating said release thread adjacent an uphole end of said sleeve.

9. The method of claim 4, comprising:

severing said tubular without string rotation.

10. The method of claim 4, comprising:

providing as said release thread a left handed square thread.

11. The method of claim 10, comprising:

providing a locator groove adjacent said square thread to facilitate connecting a release tool to said square thread.

12. The method of claim 4, comprising:

spanning a threaded connection between said tubular string and said packer extension with said sleeve.

* * * * *